US008215271B2

(12) United States Patent
Kuhl et al.

(10) Patent No.: US 8,215,271 B2
(45) Date of Patent: Jul. 10, 2012

(54) HYDRAULIC UNIT FOR A CYLINDER HEAD OF AN INTERNAL COMBUSTION ENGINE WITH HYDRAULICALLY VARIABLE GAS-EXCHANGE VALVE TRAIN

(75) Inventors: Mario Kuhl, Herzogenaurach (DE); Lothar von Schimonsky, Gerhardshofen (DE); Thomas Kremer, Fürth (DE); Calin Petru Itoafa, Höchstadt (DE); Jens Lang, Pressig (DE); Andreas Eichenberg, Chemnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 322 days.

(21) Appl. No.: 12/718,090

(22) Filed: Mar. 5, 2010

(65) Prior Publication Data

US 2010/0224148 A1 Sep. 9, 2010

(51) Int. Cl.
*F01L 9/02* (2006.01)

(52) U.S. Cl. ..... 123/90.12; 123/90.13; 92/163; 137/625

(58) Field of Classification Search ..... 123/90.12, 123/90.13; 92/163; 137/625
See application file for complete search history.

(56) References Cited

U.S. PATENT DOCUMENTS 7,509,933 B2 * 3/2009 Dingle ..... 123/90.52

FOREIGN PATENT DOCUMENTS

| | | |
|---|---|---|
| DE | 102006008676 | 8/2007 |
| DE | 102007054376 | 5/2009 |
| EP | 1243761 | 9/2002 |
| EP | 1353056 | 10/2003 |
| EP | 1559876 | 8/2005 |
| EP | 2060754 | 5/2009 |

* cited by examiner

*Primary Examiner* — Ching Chang
(74) *Attorney, Agent, or Firm* — Volpe and Koenig, P.C.

(57) ABSTRACT

A hydraulic unit (5) is provided for a cylinder head (2) of an internal combustion engine with a hydraulically variable valve train (1). In the hydraulic unit, a high-pressure chamber (11), a medium-pressure chamber (12), and a low-pressure chamber (16) used as the hydraulic medium reservoir are formed. The low-pressure chamber communicates via a throttle point (17, 17', 17", 17'") with the medium-pressure chamber, and the throttle point is formed by a displaceable valve body (19, 19', 19", 19'") and has through-flow cross sections of different sizes according to a position of the valve body.

10 Claims, 12 Drawing Sheets

HYDRAULIC UNIT FOR A CYLINDER HEAD OF AN INTERNAL COMBUSTION ENGINE WITH HYDRAULICALLY VARIABLE GAS-EXCHANGE VALVE TRAIN

CROSS-REFERENCE TO RELATED APPLICATIONS

This application claims the benefit of German Patent Application No. 102009011983.3, filed Mar. 5, 2009, which is incorporated herein by reference as if fully set forth.

FIELD OF THE INVENTION

The invention relates to a hydraulic unit for a cylinder head of an internal combustion engine with a hydraulically variable gas-exchange valve train.

The hydraulic unit comprises:

at least one drive-side master unit, at least one driven-side slave unit, at least one controllable hydraulic valve, at least one medium-pressure chamber, at least one high-pressure chamber that is arranged in the sense of transmission between the associated master unit and the associated slave unit and that can be connected by the associated hydraulic valve to the associated medium-pressure chamber, at least one low-pressure chamber that is used as a hydraulic medium reservoir and that is connected via a throttle point to the associated medium-pressure chamber, and a hydraulic housing with a bottom part of the housing, a middle part of the housing, and a top part of the housing, wherein the master unit, the slave unit, the hydraulic valve, and the medium-pressure chamber run in the bottom part of the housing, the low-pressure chamber is constructed in the top part of the housing, and the throttle point runs through the middle part of the housing in the region of a hydraulic medium passage.

BACKGROUND

Such a hydraulic unit is derived from the not previously published DE 10 2007 054 376 A1. In the case of the hydraulic unit proposed in that document, all of the essential components required for the hydraulically variable transmission of cam lobes to the gas-exchange valves and the pressure chambers are assembled in a common hydraulic housing in a sandwiched construction. The bottom part of the housing has a very compact structural configuration and the middle part of the housing involves an essentially flat plate, so that each of the medium-pressure chambers is limited to a correspondingly small volume.

As explained in the cited publication, however, a small-volume medium-pressure chamber can be problematic during the starting procedure of the internal combustion engine, especially if it involves a starting procedure at low outside temperatures and when the internal combustion engine has been at a standstill for a long time. This is based on the fact that, during the starting procedure, the hydraulic medium supply system of the internal combustion engine is still feeding an insufficient flow of hydraulic medium into the medium-pressure chamber and only the hydraulic medium volume that remains in the medium-pressure chamber and that also contracts at low temperatures is an insufficient amount for completely refilling an expanding high-pressure chamber. This problem applies to greater degrees for starting procedures repeated within a short time sequence, because in this case, the hydraulic medium consumption from the medium-pressure chamber can be larger than the volume fed back from the hydraulic medium supply system of the internal combustion engine. Such multiple starting procedures are typical, for example, for taxis at taxi stands.

For solving these problems, in the cited publication it is proposed to form in the top part of the housing a low-pressure chamber used as a hydraulic medium reservoir that is connected to the medium-pressure chamber via a throttle point in the middle part of the housing. With the help of the low-pressure chamber, first, the hydraulic medium reservoir required during the starting procedure of the internal combustion engine expands for the medium-pressure chamber and consequently for the high-pressure chamber and, second, the risk of suction of gas bubbles is largely eliminated. The latter is realized by the middle part of the housing that separates the low-pressure chamber from the medium-pressure chamber, so that, during the standstill phase of the internal combustion engine and with this cooling and consequently contracting hydraulic medium, the formation of gas bubbles in the medium-pressure chamber is prevented by the feeding of hydraulic medium from the low-pressure chamber.

The throttle point proposed in the mentioned publication is formed as a stepped borehole by the middle part of the housing with a very small diameter equal to only a few tenths of a millimeter. Such a throttle point, however, could be disadvantageous in other respects. Above all, the rigid throttle point has a through-flow characteristic that is independent of the through-flow direction with strong throttling in both directions, which acts against a quick refilling of the medium-pressure chamber especially for cold, i.e., highly viscous hydraulic medium. In addition, for hydraulic medium boreholes with very small diameters, there is increased risk of blockage in the form of production residue or wear debris during the operation of the internal combustion engine. In addition, the production of the small hydraulic medium boreholes is associated with considerable expense. For example, in the case of a borehole produced with cutting, high tool wear or frequent tool failure is to be taken into account, while production by laser beam leads to undesired high form and cross-sectional deviations from the desired geometry of the throttle point.

SUMMARY

Therefore, the present invention is based on the objective of refining a hydraulic unit of the type named above especially to the extent that, during a cold start of the internal combustion engine, both a sufficiently large and also sufficiently quick hydraulic medium reservoir is available at the side for the medium-pressure chamber.

The objective is met with the hydraulic unit according to the invention, and advantageous refinements and constructions of the invention are provided below and in the claims. Consequently it is provided that the throttle point is formed by a valve body that can be displaced relative to the hydraulic medium passage and has through-flow cross sections of different sizes according to the position of the valve body. Here, in its first position corresponding to the hydraulic medium flow from the medium-pressure chamber into the low-pressure chamber, the valve body blocks the throttle point up to a throttling through-flow cross section and opens a low-throttle through-flow cross section in its second position corresponding to the hydraulic medium flow from the low-pressure chamber into the medium-pressure chamber. In other words, the displaceable valve body allows a through-flow characteristic that is dependent on the through-flow direction, so that the hydraulic medium transfer in the direction of the low-pressure chamber is throttled as before, but is essentially low resistance in the opposite direction toward the medium-pressure chamber. In addition, with the rigid and low cross sectional hydraulic medium borehole, the risk of blockage of the throttle point by contaminant particles is eliminated.

In one refinement of the invention, the valve body should extend partially or completely in the hydraulic medium passage and should be held by stops on the middle part of the housing, with these stops defining the first and second position of the valve body. For the case that the valve body is a valve plate or has such a valve plate, the stop defining the first position of the valve body should be a first surface on the middle part of the housing facing the medium-pressure chamber and the valve plate together with the first surface should form a plate valve, with the throttling through-flow cross section being formed by one or more bead-shaped recesses on the valve plate and/or the first surface.

Relative to the steeped borehole provided in the state of the art cited above, whose throttling effect approaches the properties of a viscosity-independent screen, the throttling effect for bead-shaped recesses is dependent on the viscosity of the hydraulic medium to a significantly stronger degree due to its relatively large length-cross section ratio. This property is especially advantageous when the top part of the housing is provided with an overflow opening into the cylinder head. This is used not only for ventilating the low-pressure chamber, but also for cooling the hydraulic unit, in that heated hydraulic medium escape via the low-pressure chamber into the cylinder head and can be consequently fed back into the cooled hydraulic medium circuit of the internal combustion engine. Here, the viscosity-dependent throttling effect of the bead-shaped recesses causes a tailored flushing of the hydraulic unit that is ideally formed such that, for hot hydraulic medium, the greatest possible flushing is realized and for cold hydraulic medium, no flushing of the hydraulic unit is realized.

In one structural configuration of the invention, one or two bushings are provided fixed in the hydraulic medium passage and each forming, on the ends, one of the stops for the valve plate. Alternatively, the valve body should have holding claws that extend starting from the valve plate through the hydraulic medium passage and extend across a second surface facing the low pressure chamber on the middle part of the housing. Here, the second surface is used as the stop defining the second position of the valve body. One such valve body can be produced in an especially economical way as an injection-molded part made from plastic.

There is also the possibility that the valve body is a ball and the hydraulic medium passage has the form of a spherical shell opening in the direction of the medium-pressure chamber. Here, the throttling through-flow cross section is formed by a bead-shaped recess extending in the axial direction of the spherical shell on the inner lateral surface of the hydraulic medium passage.

For holding the ball, the stop defining the second position of the ball should be formed by one or more material projections extending into the hydraulic medium passage on the middle part of the housing. Advantageously, three material projections distributed uniformly across the inner lateral surface of the hydraulic medium passage are provided that could also be generated by swaging of the middle part of the housing.

BRIEF DESCRIPTION OF THE SEVERAL VIEWS OF THE DRAWINGS

Additional features of the invention can be taken from the following description and from the drawings in which embodiments of the invention are shown. If not otherwise mentioned, features or components that are identical or that have identical functions are provided with identical reference symbols. Shown are.

DETAILED DESCRIPTION OF THE PREFERRED EMBODIMENTS

Figure 1:
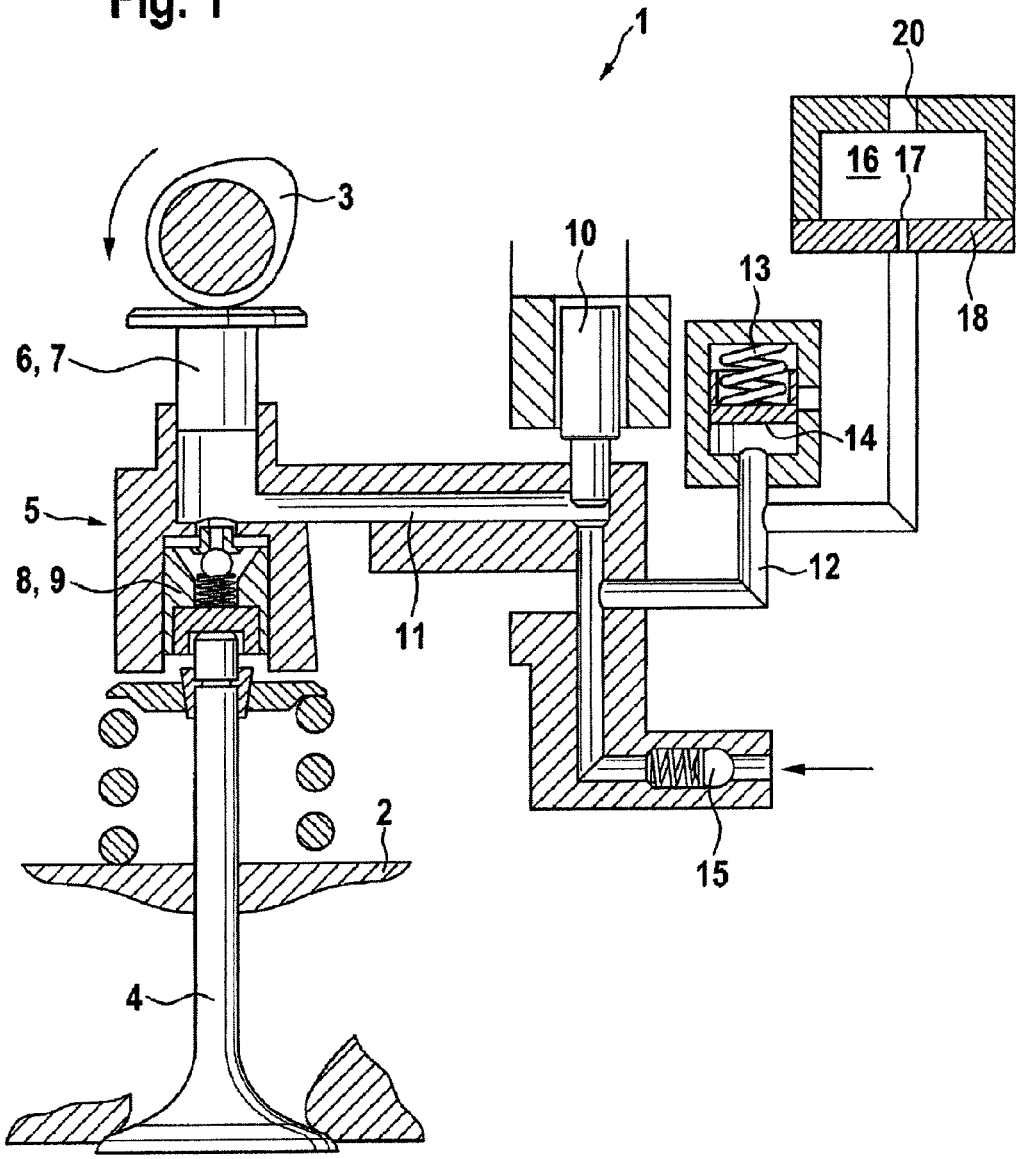
FIG. 1 is a schematic diagram of a hydraulically variable gas-exchange valve train.

In FIG. 1, the principle configuration of a hydraulically variable gas-exchange valve train 1 is disclosed schematically. Shown is a cutout that is essential for understanding the invention in a cylinder head 2 of an internal combustion engine with a cam 3 of a camshaft and a gas-exchange valve 4 that is spring loaded in the closing direction. The variability of the gas-exchange valve train 1 is generated by a hydraulic unit 5 that is arranged between the cam 3 and the gas-exchange valve 4 and that comprises the following components:

a drive-side master unit 6, here in the form of a pump tappet 7 driven by the cam 3, a driven-side slave unit 8, here in the form of a slave piston 9 directly activating the gas-exchange valve 4, a controllable hydraulic valve 10, here in the form of an electromagnetic 2-2-port switch valve, a high-pressure chamber 11 extending between the master unit 6 and the slave unit 8, wherein, for an opened hydraulic valve 10, hydraulic medium can flow out from this high-pressure chamber into a medium-pressure chamber 12, a pressure accumulator 13 connected to the medium-pressure chamber 12 with a spring-loaded compensation piston 14, a non-return valve 15 opening in the direction of the medium-pressure chamber 12, wherein, by this non-return valve, the hydraulic unit 5 is connected to the hydraulic medium circuit of the internal combustion engine, and a low-pressure chamber 16 that is used as a hydraulic medium reservoir and that is connected to the medium-pressure chamber 12 via a throttle point 17 in a separating wall 18 separating the low-pressure chamber 16 from the medium-pressure chamber 12.

The known function of the hydraulic gas-exchange valve 1 can be combined to the extent that the high-pressure chamber 11 acts as a hydraulic link between the master unit 6 and the slave unit 8, wherein—disregarding leakage—the hydraulic volume forced by the pump tappet 7 proportional to the stroke of the cam 3 is split as a function of the opening time and the opening period of the hydraulic valve 10 into a first sub-volume loading the slave piston 9 and into a second sub-volume flowing into the medium-pressure chamber 12 including the pressure accumulator 13. In this way, the stroke transfer of the pump tappet 7 to the slave piston 9 and consequently not only the control times, but also the stroke height of the gas-exchange valve 4, are fully variable.

Figure 2:
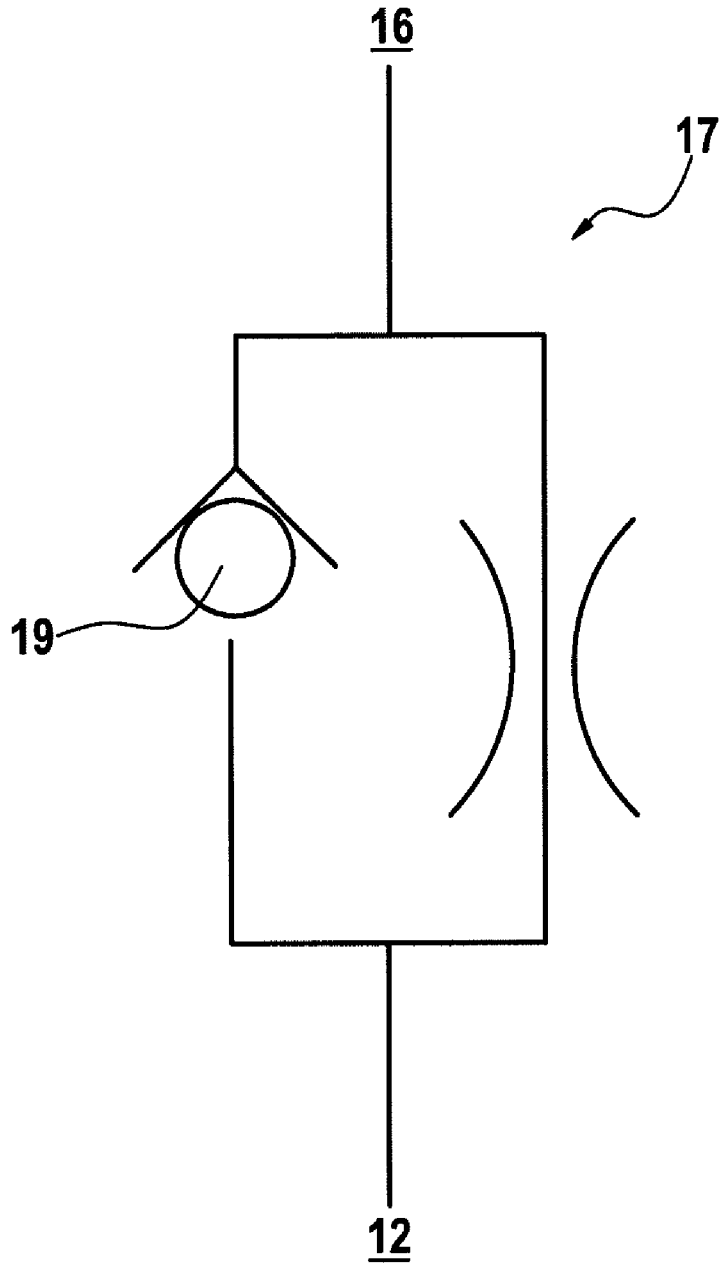
FIG. 2 is a view showing the throttle point according to the invention as a hydraulic symbol.

FIG. 2 shows the throttle point 17 as a hydraulic symbol. The existence of a displaceable valve body 19 is essential for the invention, wherein the flow of hydraulic medium from the medium-pressure chamber 12 into the low-pressure chamber 16 is throttled by this valve body significantly more strongly than in the opposite direction. As already explained above and realized in the embodiments explained below, a viscosity-dependent throttling effect of the throttle point 17 is especially advantageous if the low-pressure chamber 16 is provided with an over-flow 20 opening into the cylinder head (see FIG. 1). The overflow 20 is used not only for ventilating the low-pressure chamber 16, but also for cooling the hydraulic unit 5, in that heated hydraulic medium can escape via the low-pressure chamber 16 into the cylinder head 2 and consequently can be fed back into the cooled hydraulic medium circuit of the internal combustion engine. The viscosity-dependent throttling effect of the throttle point 17 causes a tailored flushing of the hydraulic unit 5: in the theoretically ideal case, for hot hydraulic medium, the greatest possible flushing is performed and for cold hydraulic medium almost no flushing of the hydraulic unit 5 is performed.

As becomes clear in FIGS. 3 and 4 described below, the hydraulic unit 5 has a common hydraulic housing 21, in order to be able to mount the hydraulic unit 5 as a preassembled component optionally already filled with hydraulic medium into the cylinder head 2 of the internal combustion engine. The hydraulic unit 5 constructed for a 4-cylinder in-line engine emerges in the total view from FIG. 3. The hydraulic housing 21 assembled with a sandwich construction includes a bottom part 22 of the housing, the separating wall 18 formed as the middle part 23 of the housing, and a top part 24 of the housing. While the housing parts 22, 23, 24 are screwed to each other in a hydraulically sealed manner at various screw connection points 25, the bottom part 22 of the housing has separate screw connection points 26 for fixing the entire hydraulic unit 5 in the cylinder head 2 of the internal combustion engine.

The four master units 6 each comprise a support element 27 held in the bottom part 22 of the housing, a cam follower 28 supported on this element so that it can pivot with a roller 29 mounted so that it can rotate for a low-friction cam tap and the pump tappet 7 activated here by the cam follower 28 and spring loaded in the return-stroke direction. Brackets 30 going out from the middle part 23 of the housing are used as securing devices for the cam follower 28 for a hydraulic unit 5 not mounted in the cylinder head 2. This is further constructed so that each of the master units 6 interacts with two slave units 8 (see also FIG. 1). In other words, for each pair of gas-exchange valves 4 with identical function, i.e., intake valves or exhaust valves of a cylinder of the internal combustion engine, only one cam 3 and one master unit 6 are needed, wherein the hydraulic volume forced from the pump tappet 7 simultaneously loads both slave units 8. On the side of the hydraulic unit 5 lying opposite the master units 6, the hydraulic valves 10 allocated to each master unit 6 and the two slave units 8 with electrical connection plugs 31 are shown, wherein the hydraulic valves 10 opened in the current-less state are fixed in a known way that is not shown here in more detail in valve holders in the bottom part 22 of the housing.

Figure 3:
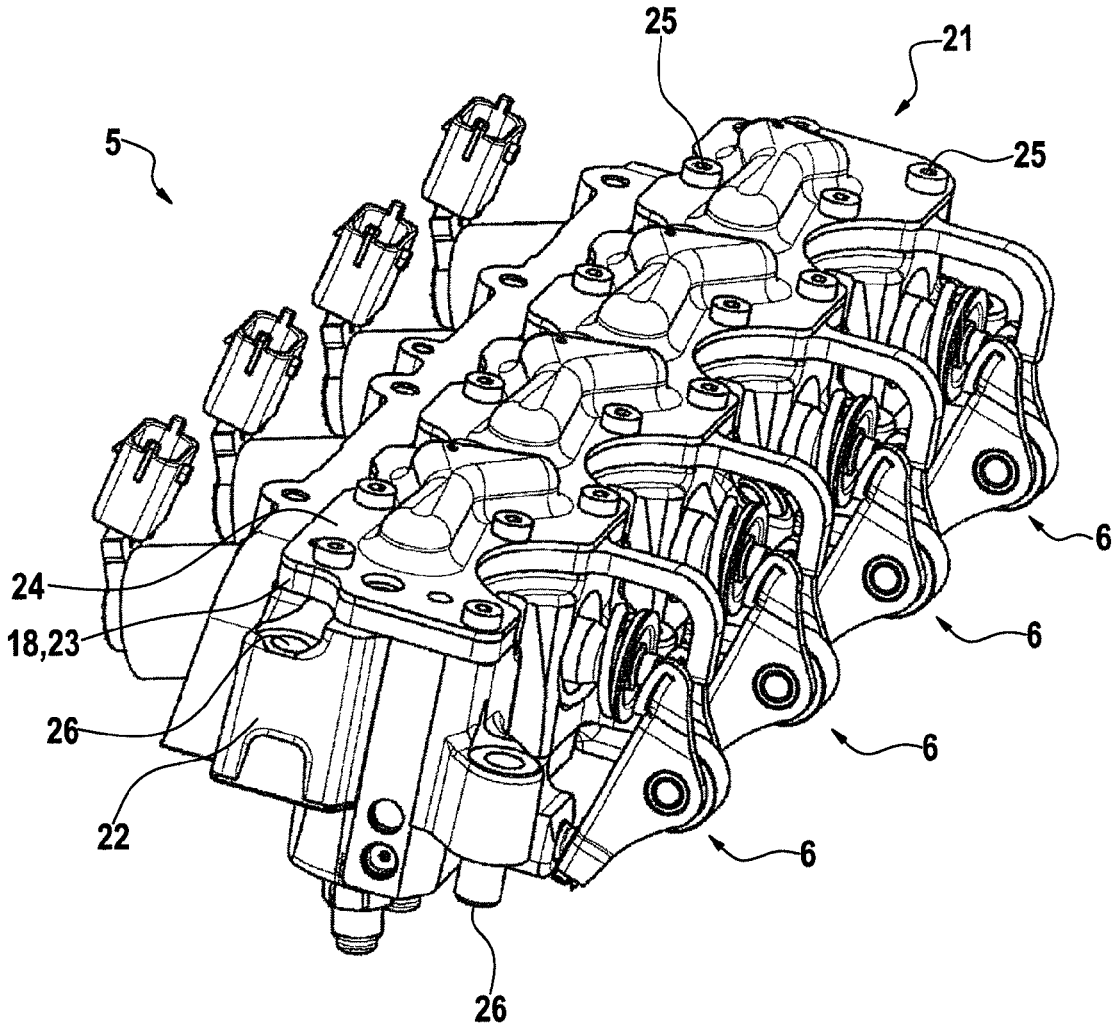
FIG. 3 is a perspective view of a hydraulic unit.
Figure 4:
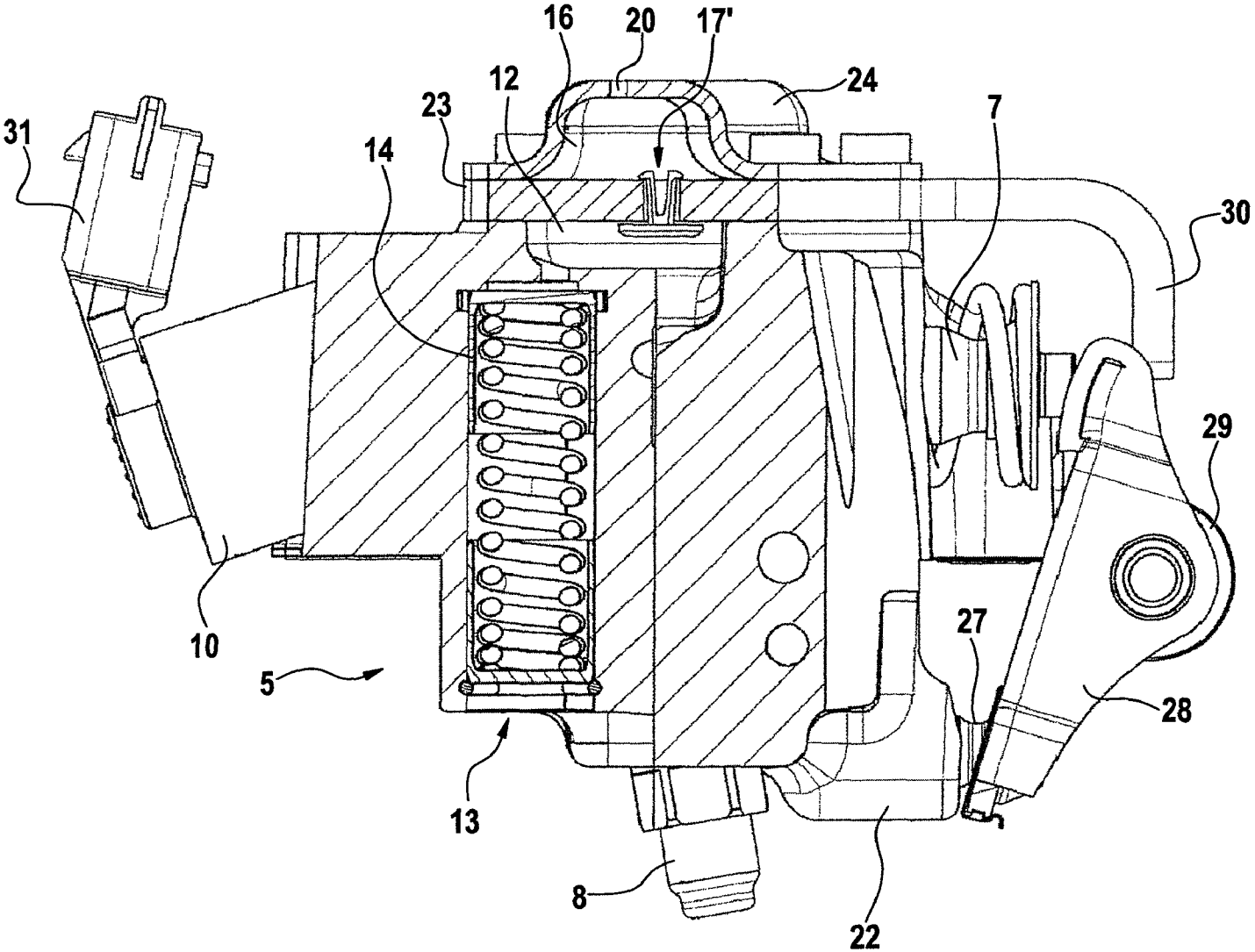
FIG. 4 is a cross sectional view of the hydraulic unit according to FIG. 3.

The low-pressure chambers 16 that can be identified already in FIG. 3 with reference to the bulges in the top part 24 of the housing clearly project out from the cross section through the hydraulic unit 5 shown in FIG. 4. In this cross section, the pressure accumulator 13 connected to the medium-pressure chamber 12 can also be seen with the spring-loaded compensation piston 14. Although only one throttle point 17' is shown, any of the medium-pressure chambers 12 could also communicate via two or more throttle points 17' with the associated low-pressure chamber 16. Conversely, it would also be conceivable to allocate two or more low-pressure chambers 16 that are separate from each other to each medium-pressure chamber 12.

Both gas bubbles that come into the low-pressure chamber 16 via the throttle point 17' from the medium-pressure chamber 12 during the operation of the internal combustion engine and also excess hydraulic medium can be discharged into the interior of the cylinder head 2 by the overflow 20 running in the top part 24 of the housing and opening into the cylinder head 2.

In order to prevent a loss of hydraulic medium from the low-pressure chamber 16, especially during the standstill phase of the internal combustion engine, the top part 24 of the housing is coated with a sealing material not shown in more detail here made from elastomeric material. In the shown embodiment, this coating is limited not only to the contact region with the middle part 23 of the housing, but is also located on the entire surface of the top part 24 of the housing produced in a deep-drawing method from a steel plate. For sealing the joints between the bottom part 22 of the housing and the middle part 23 of the housing on one side as well as between the middle part 23 of the housing and the top part 24 of the housing on the other side, in addition to or as an alternative to the elastomeric coating, separate flat seals could also be inserted, such as one-layer or multiple-layer metal seals.

In FIGS. 5 to 12 explained below, three embodiments of the throttle point 17 according to the invention are illustrated. This throttle point extends in the region of a low-throttle hydraulic medium passage 32 through the middle part 23 of the housing and is formed by the valve body 19 that is arranged partially or completely in the hydraulic medium passage 32 and that is displaceable relative to this passage. As already shown in FIG. 2 with symbols, the throttle point 17 has through-flow cross sections of different sizes according to the position of the valve body 19, wherein the valve body 19 blocks the throttle point 17 in its first position corresponding to the hydraulic medium flow from the medium-pressure chamber 12 into the low-pressure chamber 16 up to a throttling through-flow cross section and opens a low-throttle cross section in its second position corresponding to the hydraulic medium flow from the low-pressure chamber 16 into the medium-pressure chamber 12. The valve body 19 is held on the middle part 23 of the housing by stops that define the first and second positions of the valve body 19.

Figure 5:
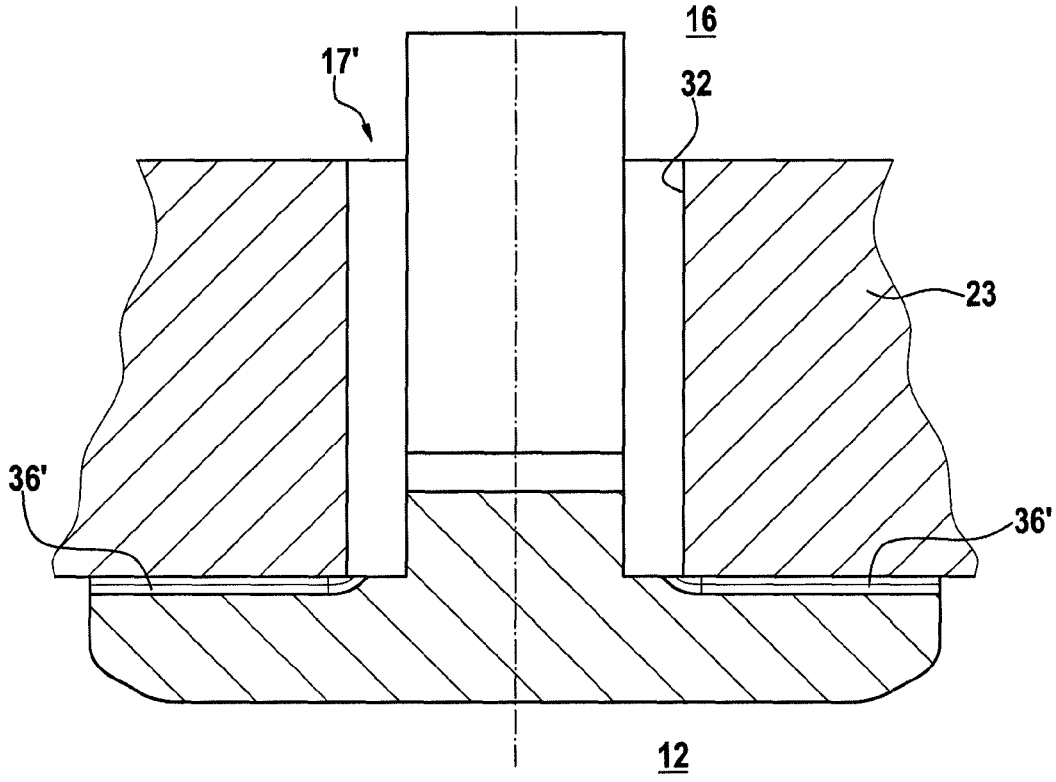
FIG. 5 is a view showing a throttle point with plate valve according to FIG. 4 in an enlarged section diagram (1st side view)
Figure 6:
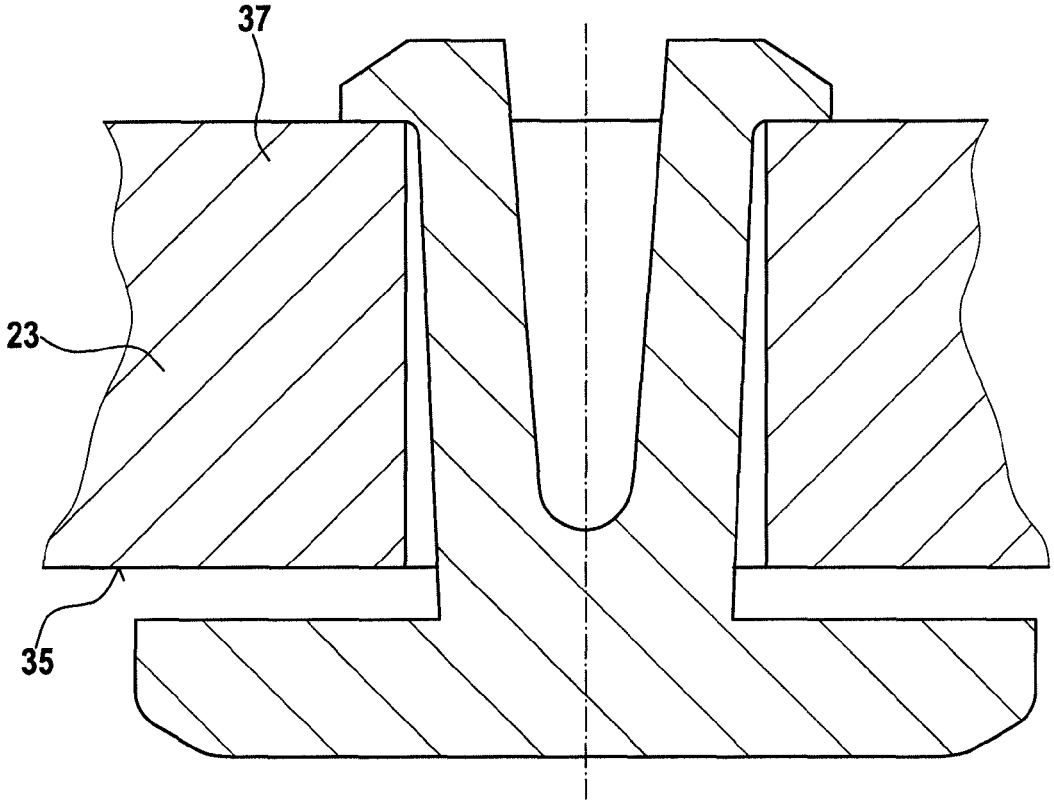
FIG. 6 is a view of the throttle point according to FIG. 4 in an enlarged section diagram (2nd side view)
Figure 7:
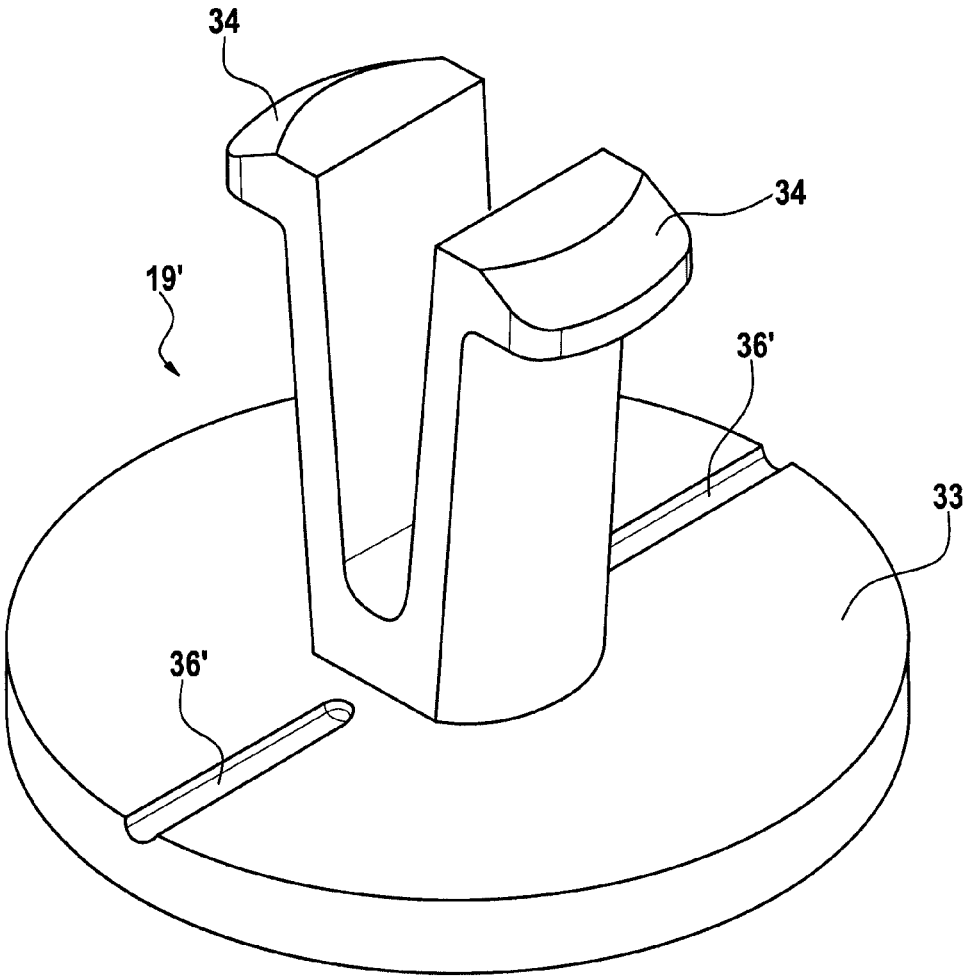
FIG. 7 is an enlarged perspective view of the valve body according to FIG. 4.

FIGS. 5 to 7 provide an enlarged representation of the throttle point 17 contained in FIG. 4 with valve body 19'. This is an injection-molded part made from plastic with a valve plate 33 and holding claws 34 that project therefrom and that are guided through the hydraulic medium passage 32 under elastic deformation. As the stop defining the first position of the valve body 19', a first surface 35 facing the medium-pressure chamber 12 on the middle part 23 of the housing is used, here its bottom side, with which the valve plate 33 forms a plate valve (see FIG. 5). The throttling through-flow cross section is formed by bead-shaped recesses 36' on the valve plate 33. In contrast, according to the desired viscosity dependency of the generated throttling effect, geometries that are different compared with the recesses 36' that here are straight are also conceivable, such as, for example, a spiral-shaped recess of low cross section and large length in the case of a very high viscosity dependency. The holding claws 34 extend across a second surface 37 facing the low-pressure chamber 16 on the middle part 23 of the housing, here its top side, which is used as the stop supporting the holding claws 34 and consequently defining the second position of the valve body 19'. As is clearly visible in FIG. 6, the throttling point 17' has, in this second position due to the plate valve that is then open, a relatively large, i.e., low-throttle cross section.

Figure 8:
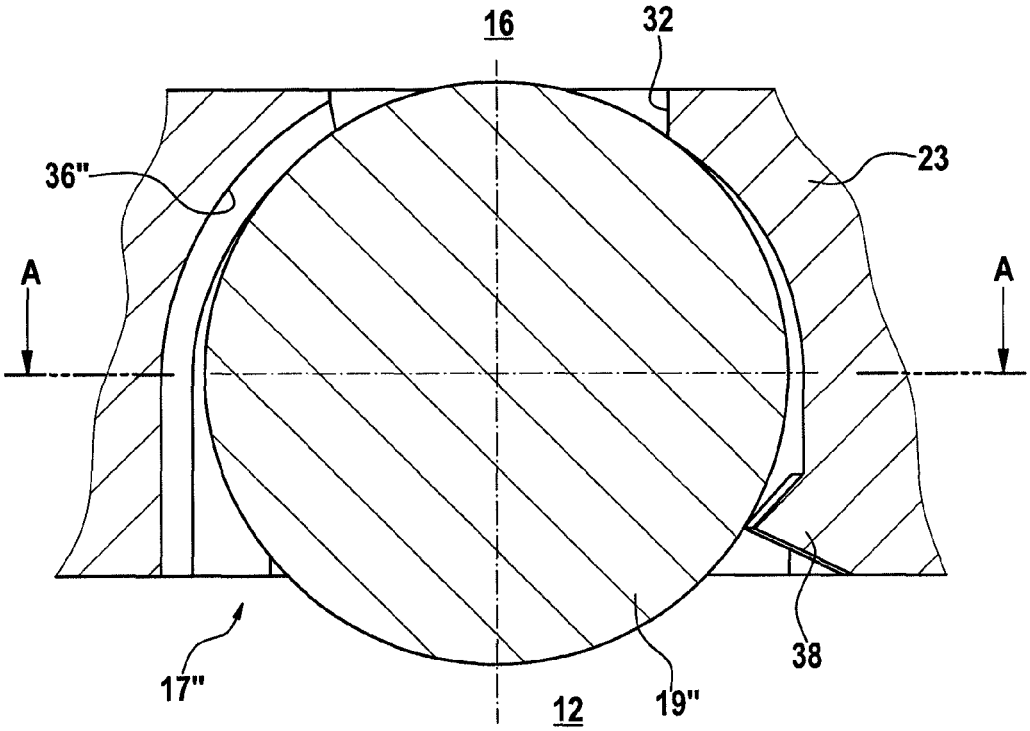
FIG. 8 is an enlarged section view of a throttle point with ball.
Figure 9:
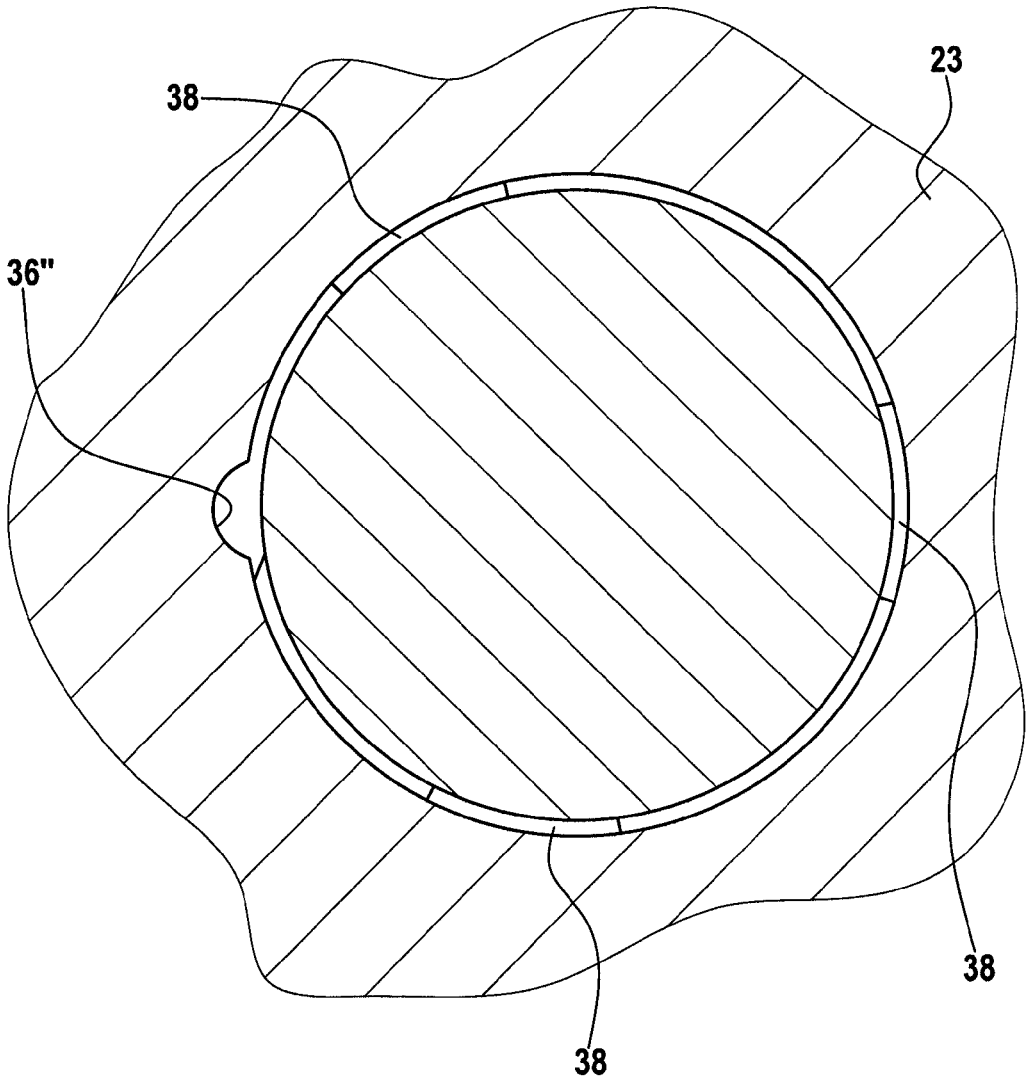
FIG. 9 is a cross-sectional view taken along the line A-A according to FIG. 8.

An alternative throttle point 17" emerges from FIGS. 8 and 9. The valve body 19" is a ball and the hydraulic medium passage 32 in the middle part 23 of the housing has the shape of a spherical shell opening in the direction of the medium-pressure chamber 12. The throttling through-flow cross section is formed by a bead-shaped recess 36" extending in the axial direction of the spherical cap on the inner lateral surface of the hydraulic medium passage 32. While the spherical shell is simultaneously used as the stop defining the first position of the ball 19" and the flow of hydraulic medium in the direction of the low-pressure chamber can be performed merely via the bead-shaped recess 36", the stop defining the second position of the ball 19" is formed by three material projections 38 on the middle part 23 of the housing. In this second position, the entire surface of the ball 19" is available to the hydraulic medium flow in the direction of the medium-pressure chamber for correspondingly low throttling. The material projections 38 extending in the hydraulic medium passage 32 are generated by swaging of the middle part 23 of the housing and are distributed uniformly across the inner lateral surface of the hydraulic medium passage 32.

Figure 10:
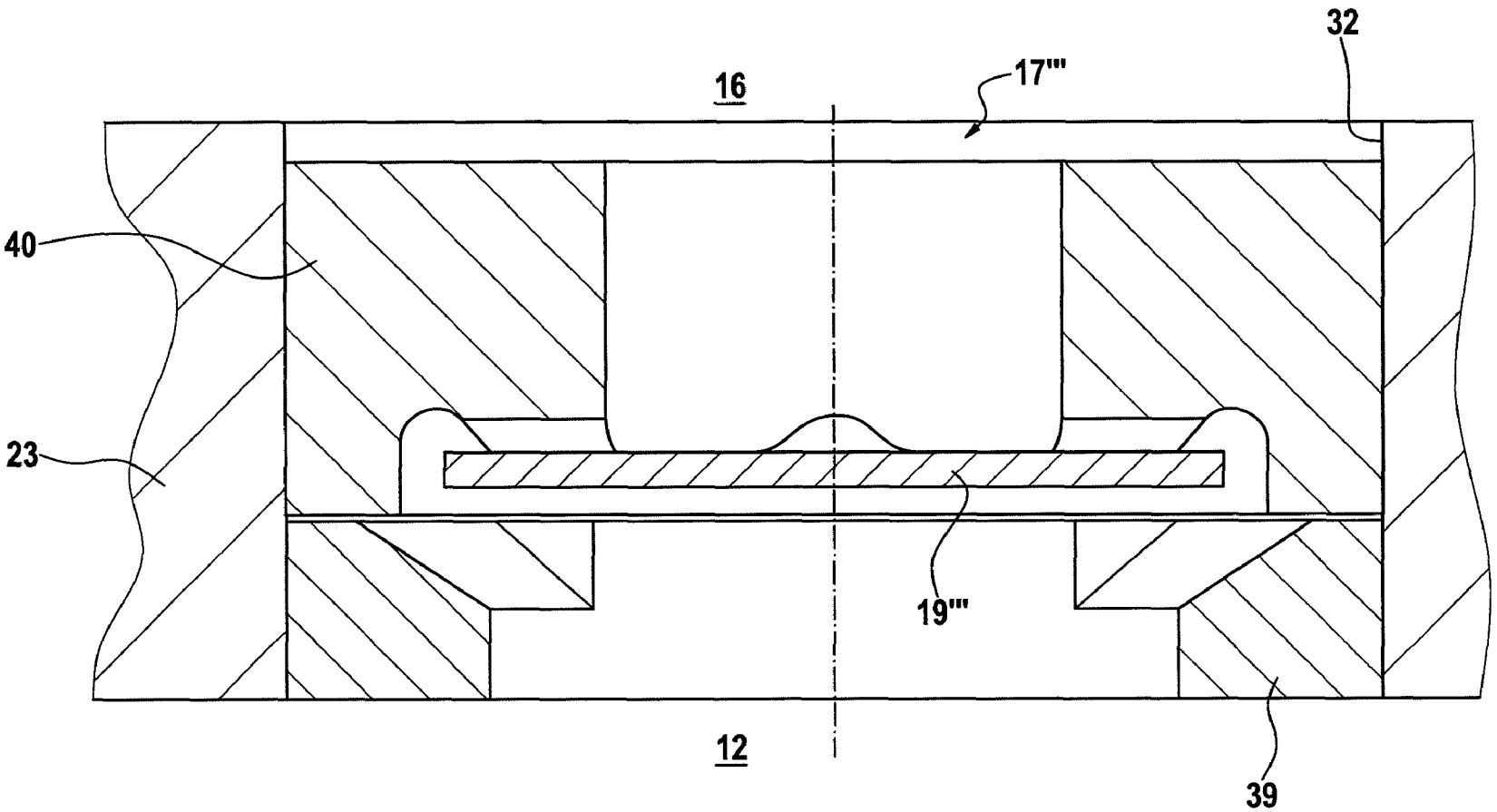
FIG. 10 is an enlarged section view of a throttle point with plate valve and bushing.
Figure 11:
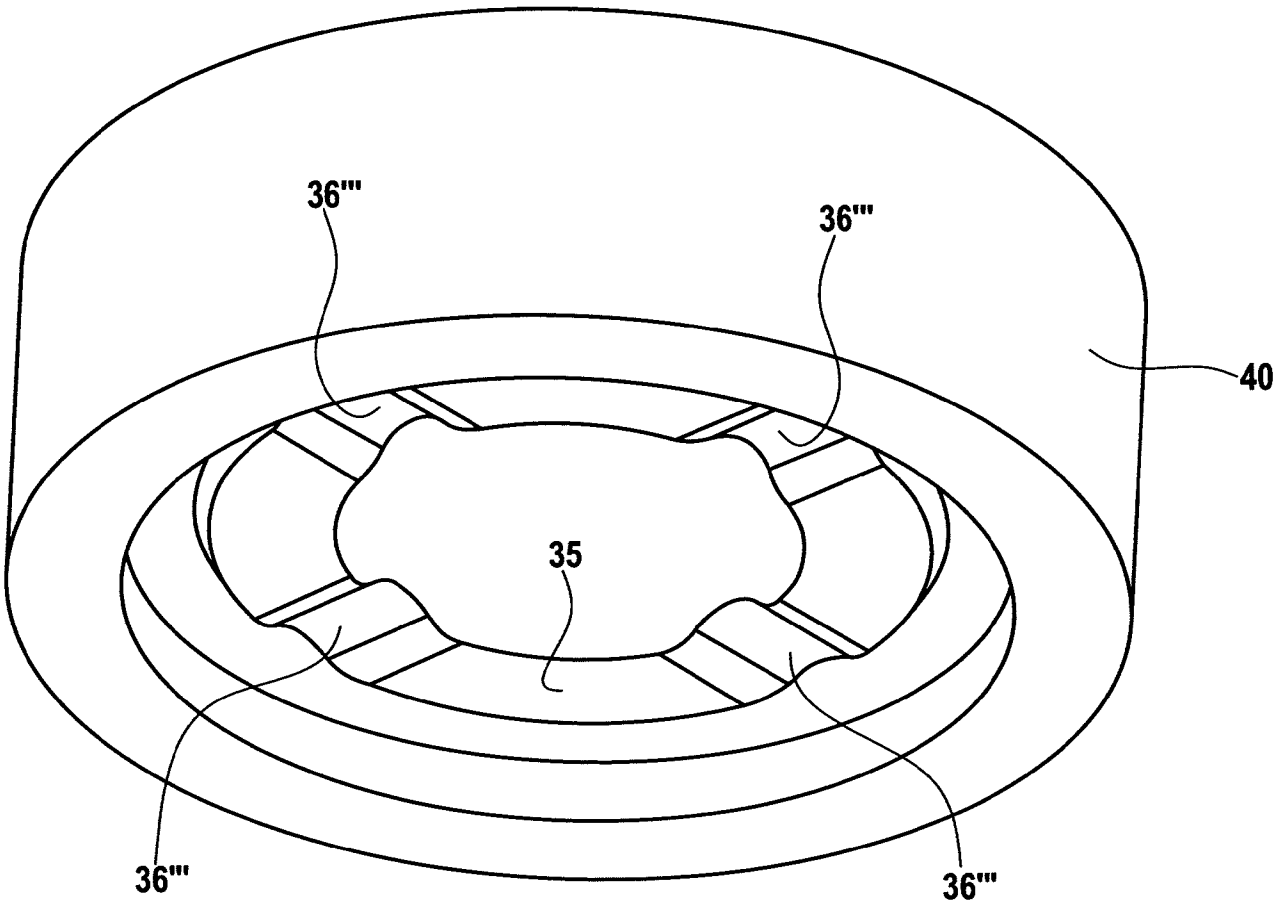
FIG. 11 is an enlarged perspective view of the upper bushing according to FIG. 10.
Figure 12:
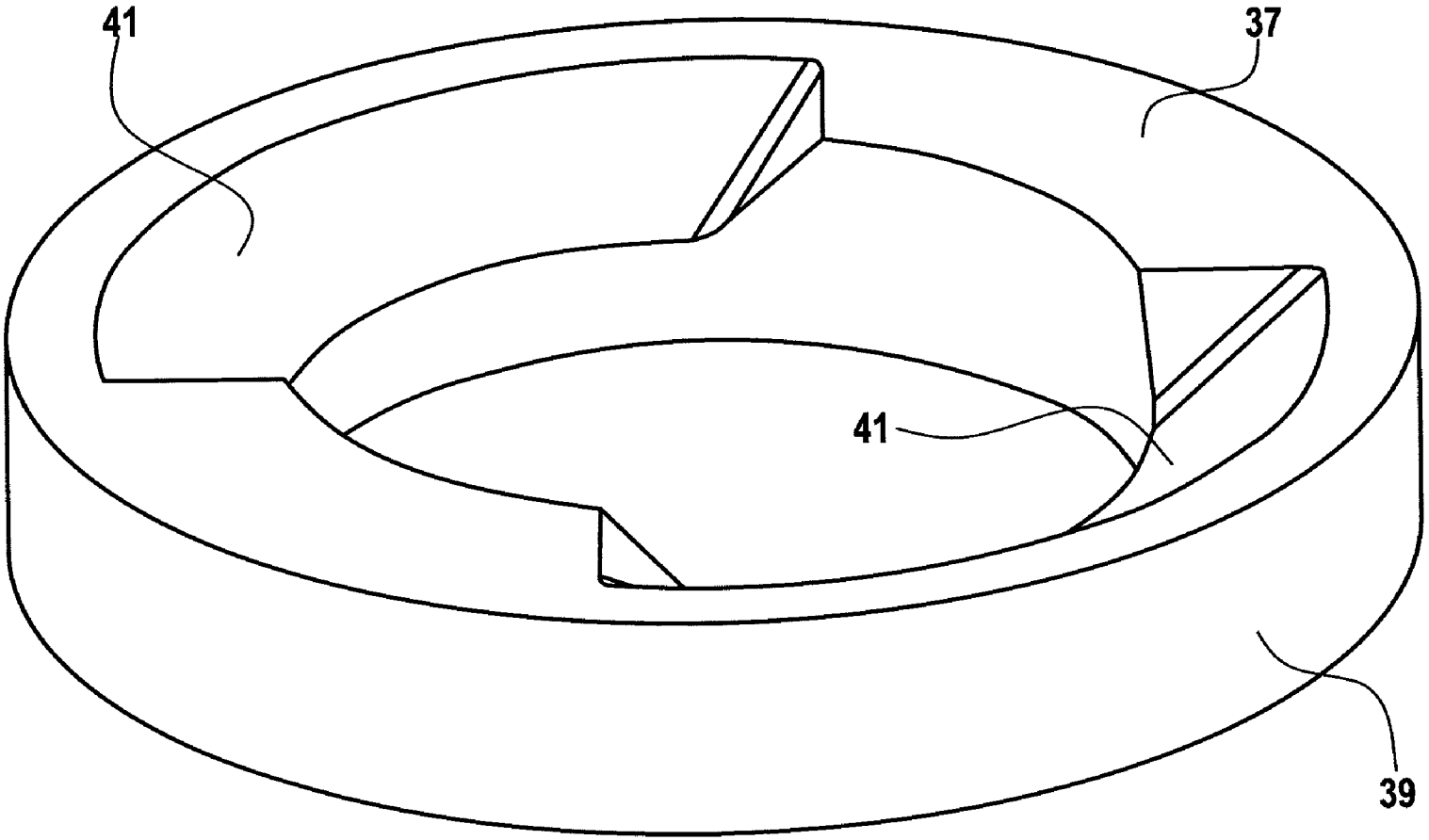
FIG. 12 is an enlarged perspective view of the lower bushing according to FIG. 10.

Another alternative throttle point 17'" is shown in FIGS. 10 to 12. The valve body 19'" is formed here as a disk-shaped valve plate that is arranged with play between two bushings 39, 40 pressed into the hydraulic medium passage 32. The bushings 39, 40 that each form, at the ends, one of the stops for the valve plate 19'" have different configurations. The upper bushing 40 forms with the valve plate 19'" a plate valve, wherein the throttling through-flow cross section is formed by four bead-shaped recesses 36'" on the first surface 35 of the bushing 40 facing the medium-pressure chamber 12. The lower bushing 39 is provided on its second surface 37 facing the low-pressure chamber 16 with circular-arc-shaped gaps 41 that make available a sufficient low-throttle through-flow cross section in the second position of the valve plate 19'".

LIST OF REFERENCE SYMBOLS

1 Gas-exchange valve train
2 Cylinder head
3 Cam
4 Gas-exchange valve
5 Hydraulic unit
6 Master unit
7 Pump tappet
8 Slave unit
9 Slave piston
10 Hydraulic valve
11 High-pressure chamber
12 Medium-pressure chamber
13 Pressure accumulator
14 Compensation piston
15 Non-return valve
16 Low-pressure chamber
17 Throttle point
18 Separating wall
19 Valve body
20 Overflow
21 Hydraulic housing
22 Bottom part of housing
23 Middle part of housing
24 Top part of housing
25 Screw connection point
26 Screw connection point
27 Support element
28 Cam follower
29 Roller
30 Bracket
31 Connection plug of the hydraulic valve
32 Hydraulic medium passage
33 Valve plate
34 Holding claw
35 First surface on the middle part of housing
36 Bead-shaped recess
37 Second surface on the middle part of housing
38 Material projection on middle part of housing
39 Bushing
40 Bushing
41 Gap

The invention claimed is:

1. The hydraulic unit for a cylinder head of an internal combustion engine with a hydraulically variable gas-exchange valve train, comprising:

at least one drive-side master unit, at least one driven-side slave unit, at least one controllable hydraulic valve, at least one medium-pressure chamber, at least one high-pressure chamber that is arranged in a transmission sense between the associated drive-side master unit and the associated slave unit and that can be connected by the associated controllable hydraulic valve to the associated medium-pressure chamber, at least one low-pressure chamber that is used as a hydraulic medium reservoir and that is connected via a throttle point to the associated medium-pressure chamber, and a hydraulic housing with a bottom part of the housing, a middle part of the housing, and a top part of the housing, wherein the master unit, the slave unit, the high-pressure chamber, the hydraulic valve, and the medium-pressure chamber extend in the bottom part of the housing, the low-pressure chamber is constructed in the top part of the housing, and the throttle point extends through the middle part of the housing in a region of a hydraulic medium passage, the throttle point is formed by a valve body that can be displaced relative to the hydraulic medium passage and has through-flow cross sections of different sizes according to a position of the valve body, and the valve body blocks the throttle point in a first position corresponding to a hydraulic-flow from the medium-pressure chamber into the low-pressure chamber up to a throttling through-flow cross section and the valve body opens a low-throttle through-flow cross section in a second position corresponding to a flow of hydraulic medium from the low-pressure chamber into the medium-pressure chamber.

2. The hydraulic unit according to claim 1, wherein the valve body extends partially or completely in the hydraulic medium passage and is held by stops on the middle part of the housing, with the stops defining the first and second positions of the valve body.

3. The hydraulic unit according to claim 2, wherein the valve body is or includes a valve plate, the stop defining the first position of the valve body is a first surface facing the medium-pressure chamber on the middle part of the housing, and the valve plate forms, together with the first surface, a plate valve, and the throttling through-flow cross section is formed by one or more bead-shaped recesses on at least one of the valve plate or the first surface.

4. The hydraulic unit according to claim 3, wherein one or two bushings are provided that are fixed in the hydraulic medium passage and each form, on ends thereof, one of the stops for the valve plate.

5. The hydraulic unit according to claim 3, wherein the valve body has holding claws that extend starting from the valve plate through the hydraulic medium passage and extend across a second surface facing the low-pressure chamber on the middle part of the housing, and the second surface is used as the stop defining the second position of the valve body.

6. The hydraulic unit according to claim 5, wherein the valve body comprises an injection-molded part made from plastic.

7. The hydraulic unit according to claim 2, wherein the valve body is a ball and the hydraulic medium passage is shaped as a spherical shell opening in a direction of the medium-pressure chamber, and the throttling through-flow cross section is formed by a bead-shaped recess extending in an axial direction of the spherical shell on the inner lateral surface of the hydraulic medium passage.

8. The hydraulic unit according to claim 7, wherein the stop defining the second position of the ball is formed by one or more material projections extending into the hydraulic medium passage on the middle part of the housing.

9. The hydraulic unit according to claim 8, wherein three of the material projections are distributed uniformly across an inner lateral surface of the hydraulic medium passage.

10. The hydraulic unit according to claim 8, wherein the material projections are generated by swaging of the middle part of the housing.

* * * * *